United States Patent [19]

Bloemers

[11] 4,345,551

[45] Aug. 24, 1982

[54] AIR AND FUEL INDUCTION SYSTEM FOR A TWO CYCLE ENGINE

[75] Inventor: James L. Bloemers, Fond du Lac, Wis.

[73] Assignee: Brunswick Corporation, Skokie, Ill.

[21] Appl. No.: 312,559

[22] Filed: Oct. 19, 1981

[51] Int. Cl.[3] ..... F02B 33/28; F02B 75/20

[52] U.S. Cl. ..... 123/59 B; 123/73 A; 123/52 M

[58] Field of Search ..... 123/59 B, 73 A, 73 R, 123/52 M

[56] References Cited

U.S. PATENT DOCUMENTS

| | | | |
|---|---|---|---|
| 3,132,635 | 5/1964 | Heidner | 123/73 A |
| 3,395,679 | 8/1968 | Christner | 123/59 B |
| 3,592,173 | 7/1971 | Frehe | 123/73 A |
| 4,178,887 | 12/1979 | Iida | 123/73 A |
| 4,181,101 | 1/1980 | Yamamoto | 123/73 A |
| 4,261,305 | 4/1981 | Ikoma | 123/73 A |
| 4,290,394 | 9/1981 | Frank et al. | 123/73 A |
| 4,305,351 | 12/1981 | Staerzl | 123/59 B |

*Primary Examiner*—Wendell E. Burns

[57] ABSTRACT

An air and fuel induction system for a two cycle engine having two adjacent horizontal cylinders positioned aligned one above the other and each having a separate closed crankcase includes a single horizontally positioned carburetor having a single metering system for supplying an air and fuel mixture to both cylinders. An induction passageway for each cylinder connects between the carburetor and each crankcase. Each induction passageway has an opening at about the same elevation and each opening has about the same cross sectional area. A reed valve is positioned adjacent the carburetor throat and at the entrance to each of the induction passageways. The reed valve includes at least one flat reed positioned directly across and closing the opening to each of the induction passageways.

11 Claims, 7 Drawing Figures

AIR AND FUEL INDUCTION SYSTEM FOR A TWO CYCLE ENGINE

DESCRIPTION

1. Technical Field

The invention relates to an air and fuel induction system and particularly concerns an air and fuel induction system for a two cycle engine.

2. Background Art

A two cycle engine such as used for an outboard motor has a vertical crankshaft and horizontal cylinders positioned vertically one above the other. With the cylinders positioned vertically, it is difficult to provide an uniform air and fuel mixture to each cylinder particularly where a single carburetor is used. The general problem is that the air and fuel mixture leaving the carburetor contains both large and small droplets of fuel. The large droplets are heavier than the small droplets and under the force of gravity they fall.

In one prior engine having two vertically positioned cylinders a vertically positioned V-shaped reed block is utilized where each side of the reed block includes a series of individual reeds. The left side supplies the lower cylinder and the right side supplies the upper cylinder. Since the reeds for both cylinders are in close proximity, it is possible to obtain an undesired rich mixture from the heavy droplets to one of the cylinders under a mid-throttle position.

In another prior engine, the V-shaped reed block is positioned horizontal. This has similar problems of not providing an uniform mixture as a result of the settlement of the heavy fuel droplets. In addition, a tilting of the engine from its horizontal position may provide the undesirable continual varying of the total mixture to each of the cylinders.

DISCLOSURE OF INVENTION

An air and fuel induction system for a two cycle engine having two adjacent horizontal cylinders positioned aligned one above the other and each having a separate closed crankcase includes a single horizontally positioned carburetor having a single metering system for supplying an air and fuel mixture to both cylinders. An induction passageway for each cylinder connects between the carburetor and each crankcase. Each induction passageway has an opening at about the same elevation and each opening has about the same cross sectional area. A reed valve is positioned adjacent the carburetor throat and at the entrance to each of the induction passageways. The reed valve includes at least one flat reed positioned directly across and closing the entrance to each of the induction passageways.

Horizontal alignment of the reed valve openings and cross positioning of the individual reeds directly at the entrance to each of the induction passageways to the upper and lower cylinders permits initial entry and delivery of an uniform range of a lean to rich air and fuel mixture to each crankcase. The substantially horizontal but slightly downward inclined passageway to the upper crankcase and the downward passageway to the lower crankcase are as close in length as possible while still maintaining a downward flow to both crankcases and in operation they provide a similar effective passageway length for supply of the air and fuel mixture. In the preferred embodiment multiple opening alternately connect multiple induction passageways to the upper and lower crankcases. Therefore, when the engine is tilted so that the induction passageway openings are tilted, the two lower openings and the two higher openings resulting from the tilt provide an average total air and fuel mixture to each of the upper and lower crankcases.

BEST MODE FOR CARRYING OUT THE INVENTION

Figure 1:
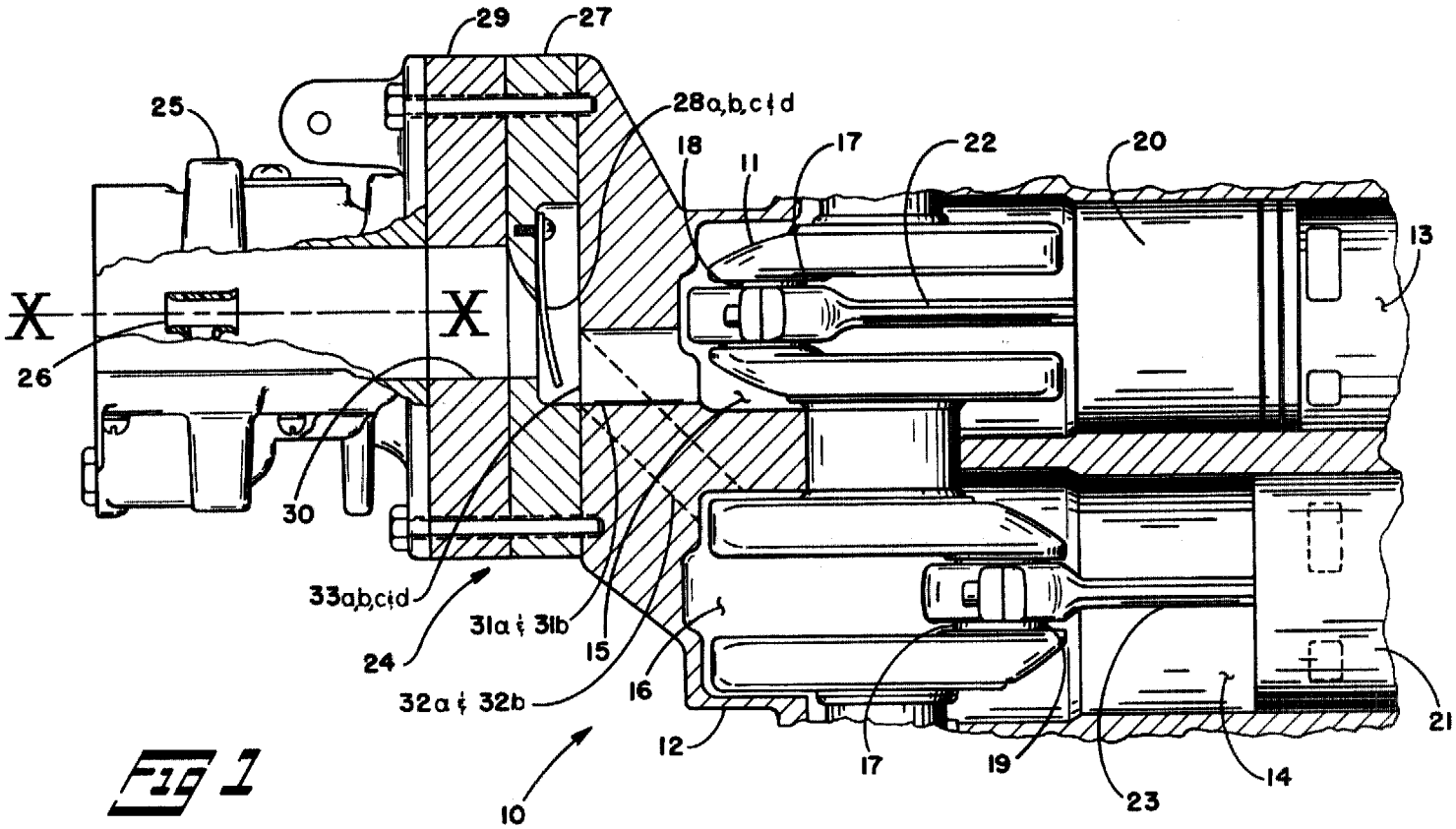
FIG. 1 is a side elevation partially in cross section of a two cycle engine illustrating an air and fuel induction system.

FIG. 1 illustrates a portion of a two cycle engine 10 having a vertical crankshaft 11 for use in a marine outboard. The engine 10 includes an engine block 12 formed with two adjacent horizontal cylinders positioned one above the other or stacked. The upper cylinder 13 has a closed upper crankcase 15 and the lower cylinder 14 has a separate closed lower crankcase 16. The crankshaft 11 is rotationally positioned within the engine block 12 in bearings 17. The crankshaft 11 includes a crank 18 for the upper cylinder 13 and a crank 19 for the lower cylinder 14. A piston 20 is reciprocately positioned in the upper cylinder 13 and a piston 21 is reciprocately positioned in the lower cylinder 14. Connecting rods 22 and 23 attach to the crankshaft cranks 18 and 19 at one end and to the pistons 20 and 21 at the other end.

An air and fuel mixture induction system 24 is attached to the engine block 12. The induction system includes a single carburetor for each two cylinders, and reed valve and induction passageways.

Figure 2:
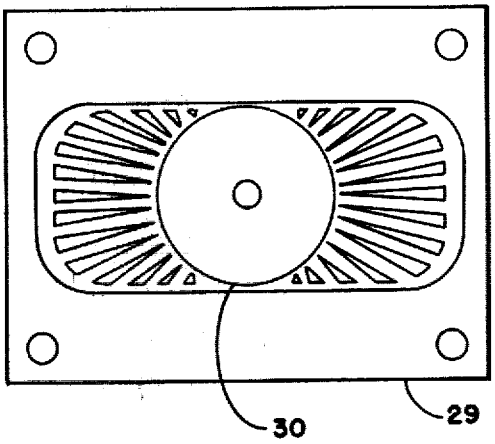
FIG. 2 illustrates the transition passageway for the induction system of FIG. 1.
Figure 3:
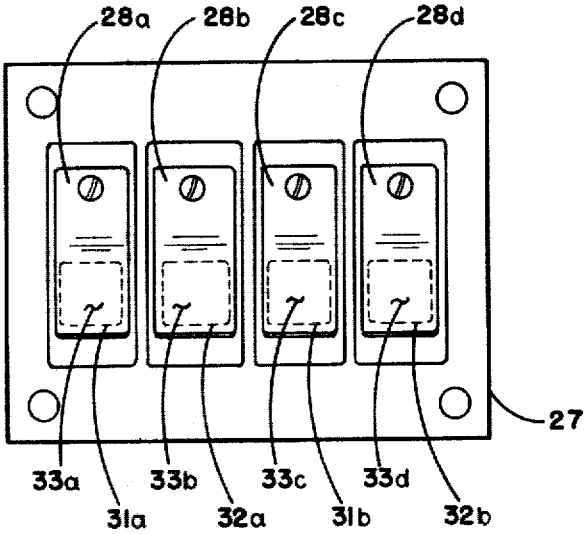
FIG. 3 illustrates the reed valve for the induction system of FIG. 1.

In the preferred embodiment of FIG. 1 a single carburetor 25 having a single metering system 26 is horizontally positioned with its axis X-X substantially parallel to the cylinders 13 and 14. A reed valve 27 having four flat reeds 28*a*, 28*b*, 28*c*, and 28*d* (shown in FIG. 3) is positioned at the exit from the carburetor 25. A transition member 29 (shown in FIG. 2) is positioned between the round throat 30 of the carburetor 25 and the reed valve 27 to blend the round throat 30 into the rectangular reed valve 27. Four induction passageways connect from the reed valve 27 to the cylinder 13 and 14. Upper induction passageways 31*a* and 31*b* connect between flat reeds 28*a* and 28*c* to the upper crankcase 15 and lower induction passageways 32*a* and 32*b* connect between flat reeds 28*b* and 28*d* to the lower crankcase 16. Although it is preferred that two induction passageways and two flat reeds are used for each cylinder dependent on engine size, a single induction passageway and a single or multiple flat reed may be used for each cylinder.

Figure 4A:
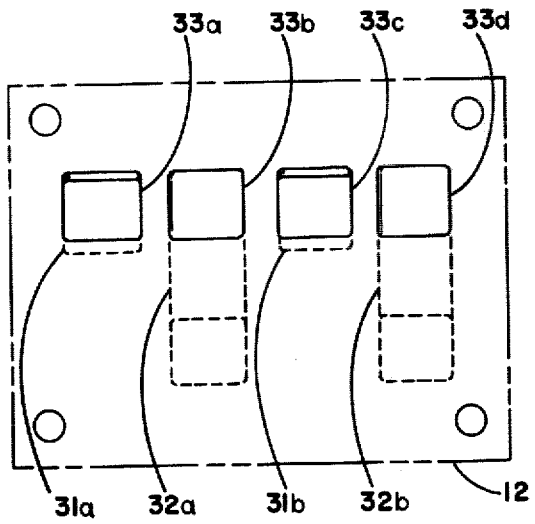
FIGS. 4*a*, 4*b*, and 4*c* all illustrate the induction passageways for the induction system of FIG. 1.
Figure 4B:
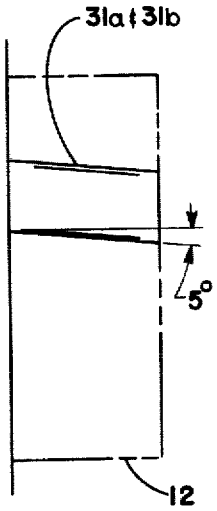
Figure 4C:
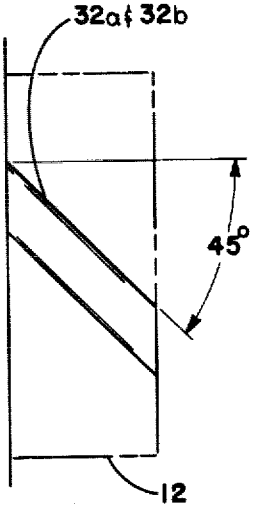

The flat reeds 28*a*, 28*b*, 28*c* and 28*d* are each formed of a flexible material. They are attached at one end and flex to open and close the induction passageways. The flat reeds 28*a*, 28*b*, 28*c*, and 28*d* are positioned directly across and close each of the openings 33*a*, 33*b*, 33*c*, and 33*d*. Referring to FIGS. 4*a*, 4*b*, and 4*c* each of the openings 3 are at about the same horizontal position and they each have about the same size and shape. In the preferred embodiment each opening is about ⅜ inch wide by ⅜ inch high and each connecting induction passageway is about ½ inch square.

The relationship of the horizontal carburetor throat 30 and the upper and lower crankcases 15 and 16 is important. In the preferred embodiment the carburetor is positioned with the upper induction passageway 31*a* and 31*b* to the upper crankcase 15 supplying cylinder 13 generally horizontal and with the lower induction passageway 32*a* and 32*b* to the lower crankcase 16 supplying cylinder 14 at a downward slope. The generally horizontal upper induction passageways are at a slightly downward slope in the range of a 1 to 5 degree angle. Although a horizontal passageway is desired a slight downward slope is necessary to eliminate the puddling of fuel which may occur in a horizontal passageway by permitting it to flow slightly downward into the upper crankcase 15. With a two cylinder engine of about 5 to 10 horsepower the slope of the induction passageway 32*a* and 32*b* to a lower crankcase is greater than a 5° angle and approaches a 45° to 60° angle. The preferred angle is 45°. In the preferred embodiment the upper induction passageways 31*a* and 31*b* are about ¾ inch long and the lower induction passageways 32*a* and 32*b* are about 1 inch long.

Although it may appear desirable not to position the carburetor as described but to position it with the horizontal throat 30 above both the upper and lower crankcase to obtain a downward fuel flow to both upper and lower crankcases, this is not ideal in practice. A long length induction passageway from the air and fuel metering system to the lower crankcase prevents intake of the same amount of fuel as a short length induction passageway to the upper crankcase. In addition, the fuel not supplied to the lower crankcase with the long length induction passageway is added to the fuel received by the short length induction passageway to the upper crankcase. This results in the lower cylinder having excess fuel and the upper cylinder insufficient fuel.

It also may appear desirable not to position the carburetor as described but to position at the upper and lower crankcases to provide an equal length and substantially symmetrical induction passageways. But, it is not ideal to have an upward sloped passageway to the upper cylinder as required by the carburetor position. Gravity may cause all the heavy fuel droplets to fall to the lower crankcase from the downward sloped passageway therefore the upper cylinder will operate lean and the lower cylinder will operate rich.

Although it can be seen from FIG. 1 that the dimensional length of the induction passageways 32*a* and 32*b* to the lower crankcase 16 is slightly longer than the dimensional length of the induction passageways 31*a* and 31*b* to the upper crankcase 15 the effective length of both upper and lower passageways is substantially equal for fuel flow. It is believed this is because the air and fuel mixture flows slightly faster in the passageways 32*a* and 32*b* at least partially due to gravity. With the described relationship, once the air and fuel mixture has entered crankcases 15 and 16 it remains generally of a substantially uniform rich or lean mixture for induction into the combustion chamber of each cylinder.

Figure 5:
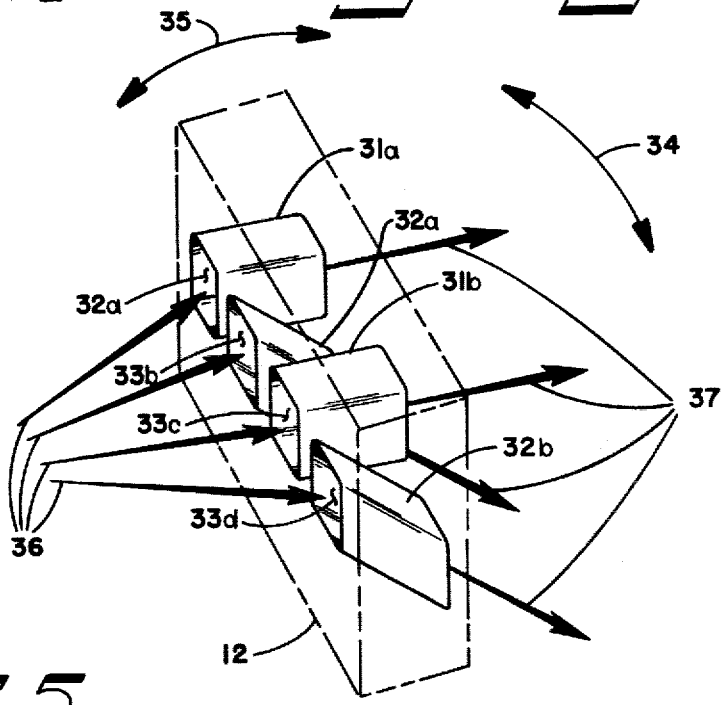
FIG. 5 is a spacial representation of the induction passageways shown in FIGS. 4*a*, 4*b*, and 4*c*.

In the preferred embodiment two induction passageways are used for each of the upper and lower crankcases as shown in plan view in FIG. 4*a*. These passageways to the upper and lower crankcases 15 and 17 alternate sequentially. This permits heavy and light fuel droplets to be generally equally provided through the passageways to the upper and lower cylinders when the engine is mounted on a boat transom. The alternate positioned induction passageways help compensate for the side tilting or rocking of the boat. The first induction passageway 31*a* and the third induction passageway 31*b*, supply the upper cylinder 13 and the second induction passageway 32*a* and fourth induction passageway 32*b* supply the lower cylinder 14. FIG. 5 illustrates that regardless of how the engine is tilted that is left or right (arrow 34) and forward or backward (arrow 35) the net amount of air and fuel mixture to each of the upper and lower cylinders is substantially equal. Arrow 36 illustrates the path of incoming air and fuel into the induction passageways 31*a*, 31*b*, and 32*b* and arrow 37 illustrates the path of air and fuel from the induction passageways into the crankcases 15 and 16.

In the operation of the upper cylinder 13 of the two cycle engine 10 described above a power stroke occurs every revolution of the crankshaft 11. This power stroke includes compression, ignition, exhaust, and air and fuel mixture intake. During compression, air and fuel is compressed by the piston 20 within the combustion chamber. At the same time fresh air and fuel mixture is drawn into the crankcase 15. The vacuum formed in the crankcase 15 during the compression stroke draws air and fuel mixture from the single metering system 26 of the carburetor 25 through the transition member 29, through the reed valve 27 and reeds 28*a*, and 28*c* and through the upper induction passageways 31*a* and 31*b*. Once the piston 20 reaches about the top of its upward movement ignition of the air and fuel mixture occurs. The burning of the mixture drives the piston 20 down to turn the crankshaft 11 providing the power output. As the piston 20 moves down exhaust occurs and the reeds 28*a* and 28*c* close. The air and fuel mixture in the crankcase 15 is simultaneously compressed. Once the piston 20 reaches the bottom of the stroke it opens the intake to the upper cylinder 13. The compressed air and fuel mixture is drawn into the upper cylinder 13. As the piston 20 moves upward the intake is closed and the power stroke repeats. The power stroke for the lower cylinder 14 is the same. The timing of the two strokes is about 180° apart.

The reeds 28*a*, 28*b*, 28*c*, and 28*d* are open during the air and fuel mixture intake and it is only during this time period that air and fuel mixture is flowing in the induction passageways 31*a*, 31*b*, 32*a* and 32*b*. This open time determines the amount of air and fuel mixture inducted through the passageways 31*a* and 31*b* into the upper crankcase 15 and the air and fuel mixture inducted through the passageways 32*a* and 32*b* into the lower crankcase 16. With the substantially horizontal passageways 31*a* and 31*b* to the upper cylinder 15 and the sloped passageways 32*a* and 32*b* to the lower cylinder the air and fuel mixture inducted to each crankcase is substantially the same.

I claim:

1. In a two cycle engine having at least two adjacent horizontal cylinders positioned aligned one above the other each having a separate closed crankcase, an air and fuel induction system comprising:

(a) a single horizontally positioned carburetor having a single metering system for supplying an air and fuel mixture to both cylinders (b) an induction passageway for each cylinder connecting between the carburetor and each crankcase, each induction passageway having an opening at about the same elevation and each opening having about the same cross sectional area, and (c) a reed valve positioned adjacent the carburetor throat and at the entrance to each of the induction passageways, said reed valve including at least one flat reed positioned directly across and closing the entrance to each of the induction passageways.

2. The engine defined in claim 1 wherein said carburetor is positioned with the induction passageway to the upper cylinder generally horizontal but at a slight downward slope into the upper crankcase and with the induction passageway to the lower cylinder at a downward slope greater than 5° into the lower crankcase.

3. In a two cycle engine having at least two adjacent horizontal cylinders in an aligned stacked position and each having an individual crankcase, and air and fuel induction system comprising:

(a) a single horizontally positioned carburetor having a single metering system for supplying an air and fuel mixture to both cylinders, (b) an induction passageway for each cylinder connecting between the carburetor and each crankcase, said induction passageways having side-by-side openings substantially adjacent the carburetor throat, said induction passageway for the upper of the two cylinders positioned generally horizontal with the downward slope towards said upper crankcase and the induction passageway for the lower of the two cylinders positioned at a downward slope towards said lower crankcase, both induction passageways having a substantially identical effective length which provides air and fuel mixture intended for each crankcase only to that crankcase whereby air and fuel mixture intended for one crankcase is not added to the other crankcase, and (c) a flexible reed positioned directly across and closing each of the side by side openings ahead of each of the induction passageways.

4. The engine defined in claim 3 wherein the actual length of the induction passageway to the upper cylinder is in the range of ½ of the same length as the length of the induction passageway to the lower cylinder and the effective lengths are substantially equal.

5. The engine defined in claim 3 wherein at least two induction passageways connect to each cylinder, the passageways alternating sequentially to the upper and lower cylinder.

6. A two cycle engine including a first horizontal cylinder having a first crankcase positioned aligned adjacently above a second horizontal cylinder having a second crankcase, said engine having an air and fuel induction system comprising:

(a) a carburetor having a substantially horizontal throat for providing an air and fuel mixture to said engine, (b) a reed assembly including at least one individual reed for each of said first and second cylinders positioned adjacent the carburetor,, (c) a carburetor transition passageway connecting between the carburetor and the reed assembly, (d) a first induction passageway connecting between the reed valve and the crankcase for said first cylinder, said first induction passageway positioned substantially horizontal with a less than 5° slope downward, and (e) a second induction passageway connecting between the reed valve and the crankcase for said second cylinder, said second induction passageway having a downward slope greater than 5°.

7. The engine defined in claim 1 wherein said first and second induction passageways have substantially the same effective length.

8. The engine defined in claim 1 comprising two first induction passageways and two second induction passageways each of said first and second passageways alternately positioned whereby heavy and light fuel droplets are generally equally provided through said induction passageways into said first and second crankcase chamber when said engine is operated in various positions ranging from vertical to slightly tilted from the vertical.

9. The engine defined in claim 1 wherein said reed valve openings in said reed assembly are at substantially the same horizontal elevation and have substantially the same cross section opening area whereby equal gravity forces act similarly on air and fuel droplets for supplying each of said first and second cylinders.

10. A two cycle engine having a first upper cylinder with a first upper crankcase positioned over a second lower cylinder with a second lower crankcase comprising:

(a) a single carburetor having a single metering system supplying an air and fuel mixture to both cylinders (b) reed valves positioned adjacent said carburetor, all of the reed valves having an inlet and outlet on the same horizontal plane, (c) induction passageways connecting between the reed valves and each of said first and second crankcases, each passageway having the same effective length and positioned with a horizontal downward slope to the upper crankcase and a greater downward slope to the lower crankcase.

11. The engine defined in claim 10 wherein the effective length of the induction passageways is such that negative pressure pulses returning from one crankcase do not add air and fuel mixture intended for that crankcase to the other crankcase as it is inducting an air and fuel mixture.

* * * * *